United States Patent [19]

Henderson

[11] 4,388,761

[45] Jun. 21, 1983

[54] SCRIBER

[76] Inventor: Clifford W. Henderson, 3945 Bradford St. (Space 103), La Verne, Calif. 91750

[21] Appl. No.: 328,378

[22] Filed: Dec. 7, 1981

Related U.S. Application Data

[63] Continuation of Ser. No. 170,883, Jul. 21, 1980, abandoned.

[51] Int. Cl.[3] ..... B43I 13/02

[52] U.S. Cl. ..... 33/42

[58] Field of Search ..... 33/41, 42, 27 C

[56] References Cited

U.S. PATENT DOCUMENTS

| | | | |
|---|---|---|---|
| 463,212 | 11/1891 | Fowler | 33/27 C |
| 670,627 | 3/1901 | Traut et al. | 33/44 |
| 750,221 | 1/1904 | Reis | 33/42 |
| 988,950 | 4/1911 | Rossell | 33/41 E |
| 1,792,393 | 2/1931 | Phillips | 33/42 |
| 2,287,601 | 6/1942 | Callaghan | 33/41 E |
| 2,347,659 | 5/1944 | Burch | 33/42 |
| 3,086,290 | 4/1963 | Kuehl | 33/41 R |
| 3,605,269 | 9/1971 | Driskill | 33/42 |
| 3,875,664 | 4/1975 | Diner | 33/42 X |

FOREIGN PATENT DOCUMENTS

| | | | |
|---|---|---|---|
| 792530 | 10/1935 | France | 33/41 F |

*Primary Examiner*—Harry N. Haroian

*Attorney, Agent, or Firm*—Christie, Parker & Hale

[57] ABSTRACT

A scribing device is provided that is useful for scribing a line on a workpiece. The scribing device includes first and second members that are in sliding engagement with one another for movement of one member relative to the other along a common axis. A roller is on one end of the first member and an orifice is in the second member for insertion of a scribe therethrough. Graduations are on one of the members for indicating the distance from the roller to the orifice along the common axis. Means are also provided for locking the two members together when the members are adjusted to provide a selected distance between the roller and the orifice.

6 Claims, 4 Drawing Figures

SCRIBER

CROSS REFERENCE TO RELATED APPLICATIONS

This is a continuation of application Ser. No. 170,883, filed July 21, 1980, now abandoned.

FIELD OF THE INVENTION

This invention relates to a scribing device useful for scribing a line on a workpiece such as a panel or the like which is to be abutted against a wall or other edge.

BACKGROUND OF THE INVENTION

It is often necessary when abutting a workpiece such as a panel or a counter top or the like against a wall to be required to cut a section from the workpiece in order to make a proper fit between the workpiece and the wall. For example, when panelling a wall, the last panel to be put in place may be too wide. A portion of the panel will, therefore, be cut off along its vertical length so that it will properly abut an adjoining wall.

One method that can be used is to first determine how much wider the panel is than desired. Then, a mark is scribed down the length of the panel corresponding to this excess width. The panel is then cut along this mark. This method, however, may not be desirable in that if the adjoining wall is not straight; for example, if it is curved or otherwise uneven, the panel will not fit properly along the entire height of the adjoining wall.

To overcome this, the panel can be placed in position before it is cut with its vertical edge against the height of the adjoining wall and its other edge overlapping an adjacent panel. In the past, a compass generally has been used to scribe a line along the panel. The compass can be set so that the distance between the point on one of the legs of the compass is spaced from a scribe on the other leg of the compass a distance which corresponds to the excess width of the panel. The compass can then be run vertically down the height of the adjoining wall and the panel for providing a scribe mark on the panel. Theoretically, the scribe mark indicates the width of the panel to be cut off so that it may properly fit against the adjoining wall.

The use of a compass, however, presents several problems. Firstly, the point of the leg of the compass passing down the length of the adjoining wall can tend to become snagged, making the scribe mark uneven. Secondly, it is difficult to keep the point of the compass and scribe in a horizontal plane when running the compass down the height of the wall. Therefore, the line drawn down the panel may not accurately reflect, for its entire length, the amount of the panel desired to be cut off. Additionally, a compass is unwieldly to handle during a scribing operation and becomes increasingly more difficult to handle as the distance from the wall to the desired scribe line becomes greater, requiring the legs of the compass to be spread further apart.

Various devices in addition to a compass that can be used to scribe a line on a workpiece or the like are also provided in the art. For example, an instrument for drawing a line contiguous to another line such as a molding or piece of furniture is described in U.S. Pat. No. 1,792,393, which discloses a ruler having two interengaging sections that are relatively movable longitudinally and secured together for sliding extensible movement by a pair of guiding clips. Guide rest arms are provided which serve as guide rests for a paint brush or pencil or the like. Openings may also be provided in the sections or in the guide rests for rigidly holding a pencil or other member. Two arms are on one end of the device and each arm is provided with a guide roller. The guide rollers maintain rectilinear movement of the instrument relative to the edge on which the rollers bear when the instrument is in use.

It is desirable, however, to provide a scribing device that locates a scribe a desired distance from a wall and on a line from the scribe perpendicular to the wall as the device is moved down the height of the wall. This is not necessarily the case when a device such as that described in U.S. Pat. No. 1,792,393 is used because of the location of the openings relative to the guide rollers.

Another scribing device useful for scribing a line on a workpiece is disclosed in U.S. Pat. No. 988,950. This device comprises a shank and a handle. The shank comprises telescopic sections and the handle can be used for holding the shank sections against relative movement. A roller is provided on one end of the telescopic sections and a clip is provided on the other end for holding a pencil or crayon. There are, however, no means provided for determining the exact distance between the roller and tip of the pencil or crayon, i.e., the scribe. In fact, means for accurately determining the distance cannot be provided since the distance between the roller and the tip of the pen or crayon or the like would depend on the position of the pencil or crayon in the holder.

A scribing device is, therefore, desirable that can be moved smoothly down a wall or other surface while the scribe is easily maintained a desired distance from the wall on a line perpendicular to the wall. The desired scribing device is of durable, simple construction and is easy to manufacture.

SUMMARY OF THE INVENTION

This invention relates to a scribing device for scribing lines on a workpiece at a selected distance from a wall or other surface. The scribed line extends along the length of the workpiece a desired distance from the wall, even when the wall is curved or otherwise uneven, so that the workpiece can fit evenly against the wall when it is cut along the line.

The scribing device comprises a first member and a second member which are received in sliding relationship for movement of one member relative to the other member. The movement of the members relative to each other is along a common axis. A roller is rotatably mounted adjacent one end of the first member and the second member has a scribe orifice therethrough. The roller and scribe orifice are about on a line along the common axis. Graduations are on one of the members for indicating the distance from the roller to the scribe orifice along the common axis. Means are provided for locking the two members together when the members are adjusted to provide a selected distance between the roller and the scribe orifice.

The scribing device is relatively flat so that it can be placed flat against the workpiece to be scribed. Additionally, the roller provided enables the scribing device to be moved smoothly along a wall adjacent the workpiece while the scribe is maintained on a line perpendicular to the wall. The roller rolls smoothly down the wall, enabling the scribing device to move smoothly along the surface of the workpiece, even though the wall may have a roughened surface or have small cracks in it or the like.

DRAWINGS

These and other features, aspects, and advantages of the present invention will be more fully understood when considered with respect to the following detailed description, appended claims, and accompanying drawings wherein:

DETAILED DESCRIPTION

Figure 1:
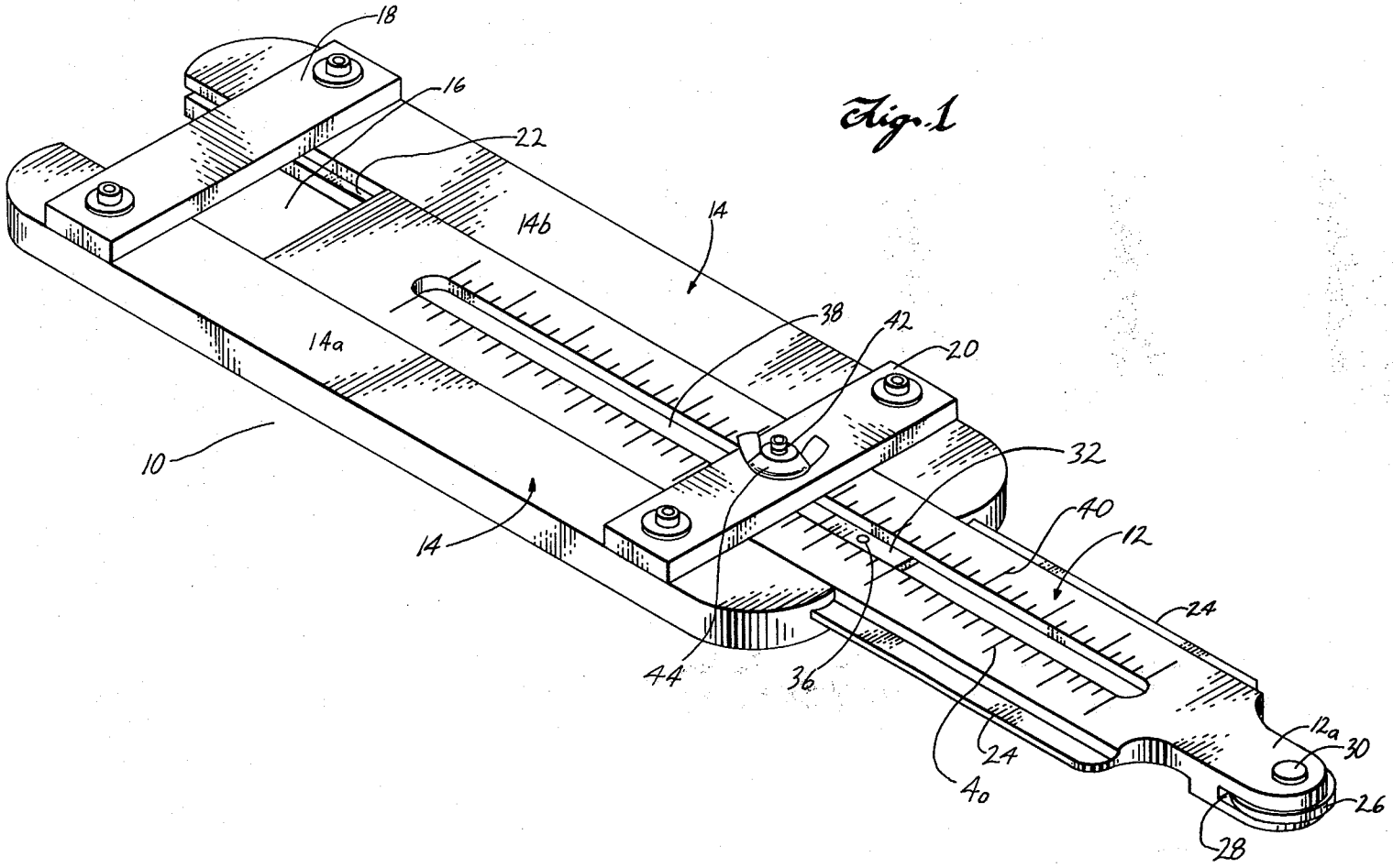
FIG. 1 is a perspective view of a preferred embodiment of a scribing device in accordance with this invention.

Referring to FIG. 1, there is shown a perspective view of a preferred embodiment of a scribing device 10 provided in accordance with this invention. The scribing device comprises an elongated first member 12 and an elongated second member 14. The first and second elongated members are generally flat and are made of wood. If desired, however, members can be made of metal or plastic or other suitable material. Although the scribing device of this invention can be used to scribe a line on a workpiece lined up in any direction, for purposes of exposition herein, the position of the components of the device relative to each other are described as if the device is placed on a horizontal surface.

The second member 14 of the scribing device comprises two opposed facing sections designated 14*a* and 14*b*. An elongated slot 16 is through the second member along its length and is defined by the opposed facing sections 14*a* and 14*b*. The second member additionally comprises two cross-braces that connect the two opposed facing sections. A first cross-brace 18 is at one end of the second member and extends across the top of the second member. A second cross-brace 20 is at the other end of the second member and also extends across the top of the second member. One end of each brace is connected to the facing section 14*a* and one end of each brace is connected to the facing section 14*b*. The ends of the braces can be connected to the facing sections by bonding with adhesive or by using screws or rivets or the like. If desired, a single cross-brace or more than two braces can be provided. The facing sections are spaced apart from each other about the same distance at one end of the second member as they are at the other end. The slot 16, therefore, is uniform along its length.

The elongated first member is slidably engaged in the elongated slot 16. The first and second members are in sliding relationship for movement of the first member relative to the second member along a common axis. In a preferred embodiment, each of the facing members has a groove 22 formed in its vertical face along its length. The first member has a longitudinal track 24 along each of its sides for engagement in the grooves. When the tracks of the first member are engaged in the grooves, the first member is held in sliding engagement with the second member.

A roller 26 is rotatably mounted at one end 12*a* of the first member. In a preferred embodiment, a horizontal slot 28 is in the end of the first member. The horizontal slot 28 is in a horizontal plane generally parallel to a horizontal plane along the length of the first member. The roller is partway in the slot with the edge, i.e., the tip of the roller, extending from the slot. The roller of a preferred embodiment is flat and has a hole through its center. A vertical axle such as a pin 30 or the like extends through the end of the first member and the hole in the roller, thereby rotatably connecting the roller to the first member. The axle, i.e., the pin 30, is about perpendicular to the common axis along which the first and second members slide relative to each other. The wheel, therefore, rotates in a horizontal plane parallel to a horizontal plane along the length of the engaged first and second members.

In a preferred embodiment, the second member comprises a scribe orifice section 32 extending between and connected to the facing members 14*a* and 14*b*. The scribe orifice section extends below the first member when the first member is slidably engaged to the second member. A scribe orifice 36 is through the scribe orifice section of the second member. Preferably, the scribe orifice is in a horizontal plane along the bottom of the second member of the scribing device. This enables the scribe orifice to be placed flat against a surface to be scribed.

A "scribe orifice" as used herein is a small hole that a scribe such as the point of a pencil or metal tip or the like can be extended through. The size of the scribe orifice can be as desired, but preferably is of a size so that just the tip of the point of a pencil can extend through while the point is held relatively firmly in engagement in the orifice.

Preferably, the scribe orifice and the roller are on a line along the common axis of the first and second members. Additionally, it is preferred that the roller be positioned as close as practical limitations of construction allow to the horizontal plane passing through the scribe orifice. For example, in the preferred embodiment, the roller is less than about $\frac{1}{4}$ inch out of the horizontal plane passing through the scribe orifice. This enables the roller to pass along that portion of the wall against which the workpiece being scribed will abut while the line is being scribed on the workpiece.

When the scribe orifice is small so that only the tip of a pencil extends through the orifice and the roller and scribe orifice are in about the same horizontal plane perpendicular to the axle of the roller, the graduations on the face accurately reflect the distance between the pencil tip, when it is inserted through the scribe orifice, and the tip of the roller.

An elongated slot 38 is through the first section and extends along its length, i.e., along the common axis of the first and second members. The scribe orifice 36 is adjacent the elongated slot 38. A scribe such as a pencil point or the like can, therefore, be inserted through the elongated slot 38 and thence through the scribe orifice. Graduations are provided on one of the members for indicating the distance from the tip of the roller to the scribe orifice along the common axis of the first and second members. For example, graduations 40 are along the horizontal face of the first member along its length. Means is provided for locking the first and second members together when the members are adjusted to provide a selected distance between the tip of the roller and scribe orifice.

In a preferred embodiment, a hole is through the cross-brace 20 at about the center of the brace. A bolt 42 is inserted through the slot in the first member with the head of the bolt bearing against the underside of the first member. The threaded end of the bolt extends through the hole in the cross-brace 20 and has a wing nut 44 or the like on its threaded end. When the wing nut is tightened, the first member is locked in position relative to the second member.

Figures 2, 3, 4:
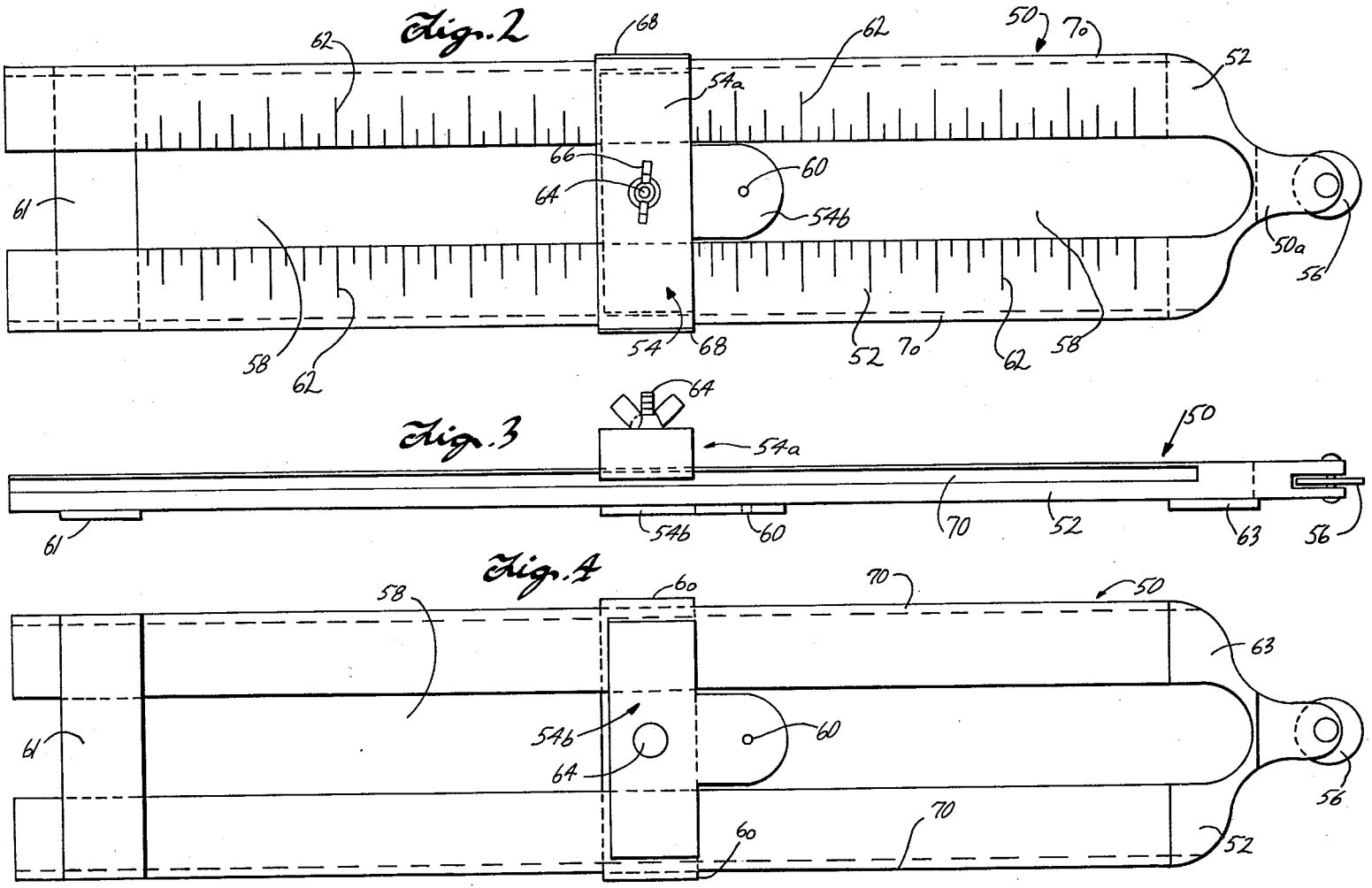
FIG. 2 is a top view of another preferred embodiment of a scribing device in accordance with this invention.
FIG. 3 is a side view of the scribing device shown in FIG. 2.
FIG. 4 is a bottom view of the scribing device shown in FIG. 2.

Referring now to FIGS. 2, 3, and 4, another preferred embodiment of a scribing device 50 provided in accordance with this invention is shown. Like reference numerals describe identical components of the scribing device as shown in each of the three figures.

In the preferred embodiment, the scribing device comprises an elongated first member 52 and a second member 54. The first and second members are in sliding relationship for movement of one member relative to the other member along a common axis.

A roller 56 is rotatably mounted adjacent one end 50*a* of the first member. The roller 56 and its mounting is similar to the roller 26 and its mounting in the embodiment as shown in FIG. 1.

The first member 52 has an elongated slot 58 therethrough extending along the common axis.

The second member 54 is slidably mounted on the first member.

In a preferred embodiment, the second member has two sections: a top section 54*a* connected to a bottom section 54*b*. The top section 54*a* slides along the face of the first member 52. The bottom section 54*b* slides along the bottom of the first member 52. A scribe orifice 60 is through a portion of the bottom section 54*b* that extends along the length of the slot 58 and is below the first member. The scribe orifice 60, therefore, can be placed flat against the surface to be scribed. The scribe orifice of this embodiment is similar to the scribe orifice as described for the preferred embodiment shown in FIG. 1.

Preferably, the roller is positioned as close as practical limitations of construction allow to the horizontal plane passing through the scribe orifice. In the preferred embodiment, the roller is less than about ¼ inch out of the horizontal plane passing through the scribe orifice.

Since the bottom section 54*b* of the second member extends below the first member, pads 61 and 63 are bonded to the undersurface of the first member. The pad 61 is at about one end of the first member. The pad 63 is at about the other end. The pads 61 and 63 have a thickness about equal to the distance that the bottom section 54*b* extends below the first member. The pads, therefore, enable the scribe orifice to be placed flat against a surface to be scribed while the scribing device remains stable as it is moved smoothly along a surface.

Graduations 62 are on the face of the first elongated member adjacent the elongated slot.

Both the top and bottom sections of the second member have a vertical hole therethrough and a bolt 64 extends through the holes. The head of the bolt bears against the bottom portion of the bottom section and the threaded end of the bolt extends from the hole in the top section. A nut, such as a wing nut 66, is on the threaded end of the bolt. The nut holds the top and bottom sections together so they can slide along the first member. Additionally, the nut and bolt provides a means for locking the two sections of the second member together when the first and second members are adjusted to provide a selected distance between the roller and the scribe orifice.

In a preferred embodiment, the second member also includes a metal plate 68 attached to each end of the top section 54*a*. One end of each of the metal plates extends into a groove 70 formed along the length of each side of the first member. Having the edge of each metal plate in the groove aligns the first member with a second member as the first member is positioned relative to the second member.

Both preferred embodiments of the scribing device in accordance with this invention are used similarly so that for purposes of exposition, the use of only one is described below.

When it is determined that a line need be scribed at a particular distance from a wall or other surface, the scribing device provided in accordance with this invention is particularly useful. The distance from the wall to the desired scribe line is determined and the wing nut is loosened so that the tip end of the roller can be positioned the desired distance from the scribe orifice. This distance is conveniently shown on the graduations which are on the face of the first member. Once the distance from the scribe orifice to the roller is set, the wing nut is tightened so that the first and second members are fixed, i.e., locked, in position relative to one another. The scribing device is then placed flat against the surface to be scribed with the tip of the roller against a wall or other surface. Generally, the wall is at about a 90° angle to the surface to be scribed. A pencil tip or other scribing device is then positioned in the scribe orifice. The scribing device is then moved along the wall while maintaining the line between the scribe orifice and roller perpendicular to the wall. As the scribing device is moved down the wall, any discontinuities in the wall are taken into account as the roller rolls over these discontinuities. For instance, when the wall is curved, the scribing device will scribe a mark on the workpiece, taking the curvature into account. The roller rolls smoothly down the wall and does not get caught in any cracks or on the roughened surface of the wall.

Once the line is scribed on the workpiece, the workpiece is cut along the line so that it can be abutted perfectly against contours of the wall.

The above description of preferred embodiments of scribing devices provided in accordance with this invention is for illustrative purposes. Because of variations which will be apparent to those skilled in the art, the present invention is not intended to be limited to the particular embodiments described hereinabove. The scope of the invention is defined in the following claims.

What is claimed is:

1. A scribing device comprising:

first and second members;

means receiving the members in sliding relationship for movement of one member relative to the other member along a common axis;

a single roller rotatably mounted on one end of the first member, the second member having both a scribe orifice and an elongated slot therethrough, the slot extending along the common axis, wherein the first member slidably engages the elongated slot and the scribe orifice is aligned with the elongated slot, and wherein the first member has an elongated slot therethrough extending along the common axis for providing that a scribe can be inserted through said elongated slot in the first member and then through the scribe orifice, the scribe orifice being sufficiently large to allow the tip of a pencil to extend therethrough, yet being small enough to hold the pencil tip relatively firmly in engagement therein, the roller and scribe orifice being about on a line along the common axis;

means for locking the two members together when the members are adjusted to provide a selected distance between the roller and scribe orifice; and graduations on one of the members for indicating the distance from the roller to the scribe orifice along the common axis.

2. A scribing device according to claim 1 wherein the locking means is a bolt with a nut on its end extending through the elongated slot in the first member.

3. A scribing device comprising:

(a) an elongated first member comprising a single roller rotatably mounted on one of its ends;

(b) an elongated second member comprising two opposed facing sections fixedly connected together at their ends, said opposed facing sections defining an elongated slot through the second member along its length wherein the elongated first member slidably engages the elongated slot in the second member for movement of the first member relative to the second member along a common axis;

(c) a scribe orifice section connected between the opposed facing sections of the elongated second member, said scribe orifice section extending below the first member when the first member is slidably engaged in the elongated slot of the second member;

(d) a scribe orifice through the scribe orifice section wherein the single roller and scribe orifice are about on a line along the common axis;

(e) an elongated slot through the first member extending along the common axis for providing that a scribe can be inserted through the elongated slot in the first member and through the scribe orifice in the scribe orifice section of the second member; and (f) graduations on one of the members for indicating the distance from the roller to the scribe orifice along the common axis.

4. A scribing device according to claim 3 wherein the width of the elongated slot through the second member is uniform along its length.

5. A scribing device according to claim 3 wherein the graduations are on the first member adjacent the elongated slot through the first member.

6. A scribing device according to claim 3 wherein the roller and scribe orifice are about in the same plane so that the graduations accurately reflect the distance from the tip of a scribe in the scribe orifice and the tip of the roller.

* * * * *